US007237360B2

(12) United States Patent
Moncho et al.

(10) Patent No.: US 7,237,360 B2
(45) Date of Patent: Jul. 3, 2007

(54) SHELTER

(75) Inventors: Fernando R. Moncho, Madrid (ES); Juan M. Norverto, Madrid (ES)

(73) Assignee: Cemusa, Inc., Miami, FL (US)

( * ) Notice: Subject to any disclaimer, the term of this patent is extended or adjusted under 35 U.S.C. 154(b) by 366 days.

(21) Appl. No.: 10/670,159

(22) Filed: Sep. 23, 2003

(65) Prior Publication Data

US 2005/0072060 A1 Apr. 7, 2005

(51) Int. Cl.
*E04F 19/00* (2006.01)

(52) U.S. Cl. ..... 52/28; 40/442; 40/605; 52/36.2; 52/79.1; 52/239; 362/145; 362/183

(58) Field of Classification Search ..... 52/11, 52/15, 73, 93, 94, 96, 261, 262, 263, 95, 52/28

See application file for complete search history.

(56) References Cited

U.S. PATENT DOCUMENTS

| | | | | | |
|---|---|---|---|---|---|
| 3,762,109 | A | * | 10/1973 | Cohen | 52/11 |
| 4,018,016 | A | | 4/1977 | Zale | |
| D250,836 | S | * | 1/1979 | Lahaie | D25/1 |
| D252,215 | S | * | 6/1979 | Leuthesser | D25/1 |
| 4,384,317 | A | | 5/1983 | Stackpole | |
| 4,410,930 | A | | 10/1983 | Yachabach | |
| 4,718,185 | A | | 1/1988 | Conlin et al. | |
| 4,754,582 | A | | 7/1988 | Cameron | |
| 5,107,637 | A | | 4/1992 | Robbins | |
| D336,136 | S | * | 6/1993 | Foster | D25/1 |
| D338,073 | S | * | 8/1993 | Wall | D25/56 |
| 5,363,608 | A | | 11/1994 | Conlan | |
| D403,434 | S | * | 12/1998 | Sauder | D25/1 |
| D406,352 | S | * | 3/1999 | Kleihues | D25/1 |
| D436,669 | S | | 1/2001 | Kieffer | |
| D438,635 | S | * | 3/2001 | Da Costa | D25/1 |
| 6,295,767 | B1 | * | 10/2001 | Barnhill et al. | 52/79.1 |
| 6,415,557 | B1 | | 7/2002 | McCalley | |

FOREIGN PATENT DOCUMENTS

| | | |
|---|---|---|
| ES | 2 159 255 | 9/2001 |

OTHER PUBLICATIONS

Four images believed to be on display on Cemusa's website prior to filing the application.

* cited by examiner

*Primary Examiner*—Yvonne M. Horton
(74) *Attorney, Agent, or Firm*—Brinks Hofer Gilson & Lione

(57) ABSTRACT

A shelter and a method of providing a shelter are provided. The shelter includes a roof structure supported by a plurality of wall structures. The wall structures are anchored securely into at least one foundation. A display panel extends adjacent to at least one of the wall structures but is structurally separate therefrom. The display panel includes advertising materials.

15 Claims, 13 Drawing Sheets

SHELTER

FIELD OF THE INVENTION

The present invention relates to shelters. In particular, the present invention relates to passenger transit shelters able to withstand hurricane force winds.

BACKGROUND

Transit shelters provide covered areas for passengers waiting for transportation, for example, a bus or a train. It is desirable to provide waiting passengers with protection from the elements, such as wind and precipitation, as well as to provide safety by providing a lighted area. Additionally, it is desirable to have transit shelters that blend into the urban setting and that may be placed at any location within a city without detracting from the surrounding area. Transit shelters that maintain their pleasing appearance over time and that do not require continual maintenance, such as painting or refinishing, are also advantageous.

In typical prior art shelters and the most secure and aesthetically pleasing structure has traditionally included a rear wall, one or two side walls and a partial front wall supporting a roof structure. This supplies shelter from wind and rain from nearly all sides. Shelters are typically scant structures, both for economic and aesthetic purposes. Often, in hurricane-prone or high-wind locations, structural damage may occur with prior art structures.

Transit shelters also may be used for advertising displays. In prior art structures, one of the walls of the shelter to attract the attention of waiting customers. Lighted advertising displays are especially advantageous for an income revenue stream for the shelter owner to defray the cost of the shelter. The displays also provide light for the shelter for increased safety and to deter theft and vandalism. However, providing conventional lighting in shelters in urban and rural areas is expensive because a permanent power supply must be linked to each shelter. Therefore, an alternative energy source, such as solar energy, to provide a self-contained lighted shelter is highly desirable.

Thus, a need exists to provide a transit shelter that also is hurricane wind resistant and maintains its integrity and appeal over time after repeated exposure to the elements and further provides a self-contained lighting source.

BRIEF SUMMARY

In order to alleviate one or more shortcomings of the prior art, a shelter is provided herein.

According to one aspect of the present invention, there is provided a shelter comprising a plurality of posts upstanding from a foundation. The posts are arranged to at least partially surround a spatial area. At least one roof structure is mounted to the plurality of posts, the roof structure is positioned over the spatial area, and at least one wall is secured to at least one of the posts. The shelter further comprises a panel display upstanding from the foundation and unattached to the posts, the roof, and the wall. Solar power componentry, including batteries, solar panels and charging circuitry, may be linked to lighting means for the spatial area, including the panel display. The panel display comprises a side edge aligned with at least one of the upstanding posts to give the illusion of structural integration with the remainder of the shelter structure. This shelter configuration provides protection to the spatial area from strong winds.

In another aspect of the present invention, there is provided a shelter comprising a plurality of posts upstanding from a foundation. The posts are arranged to at least partially surround a spatial area. At least one roof structure is mounted to the plurality of posts, the roof structure is positioned over the spatial area, and the roof structure has a first edge. At least one freestanding wall structure is secured to the foundation and the wall structure comprises an edge extending parallel to said first edge of said roof structure.

In yet another aspect of the present invention, a method of providing a wind resistant shelter is provided. The method comprises providing a plurality of upstanding posts secured to a foundation. The posts are arranged to at least partially surround a spatial area. A roof structure secured to the plurality of posts is provided. The method further includes providing at least one wall secured to at least one of the posts. The wall provides space between the foundation and the roof structure for air flow therethrough. At least one freestanding wall structure including an edge extending parallel to the at least one wall is provided. The freestanding wall structure includes space around the freestanding wall structure to allow air to flow around the structure. Vibration of the wall structure due to wind will not transfer directly to the other structures of the shelter such as the roof and other walls.

In another aspect of the present invention, a shelter comprising a plurality of walls having supports is provided. The walls surround a spatial area. The shelter further comprises a roof structure mounted to the supports and at least one freestanding panel mounted adjacent at least one of the walls. The freestanding panel includes a frame for containing advertising materials. The freestanding panel is not attached to the supports or the roof structure.

Other objects and advantages will be apparent from the following description of the invention, and the various features of that invention will be particularly pointed out in conjunction with the preferred embodiments. As realized, the invention is capable of other and different embodiments, and its details are capable of modification in various respects. Accordingly, the drawings and description are to be regarded as illustrative in nature and not as restrictive.

DETAILED DESCRIPTION OF THE DRAWINGS AND THE PRESENTLY PREFERRED EMBODIMENTS

Figure 1:
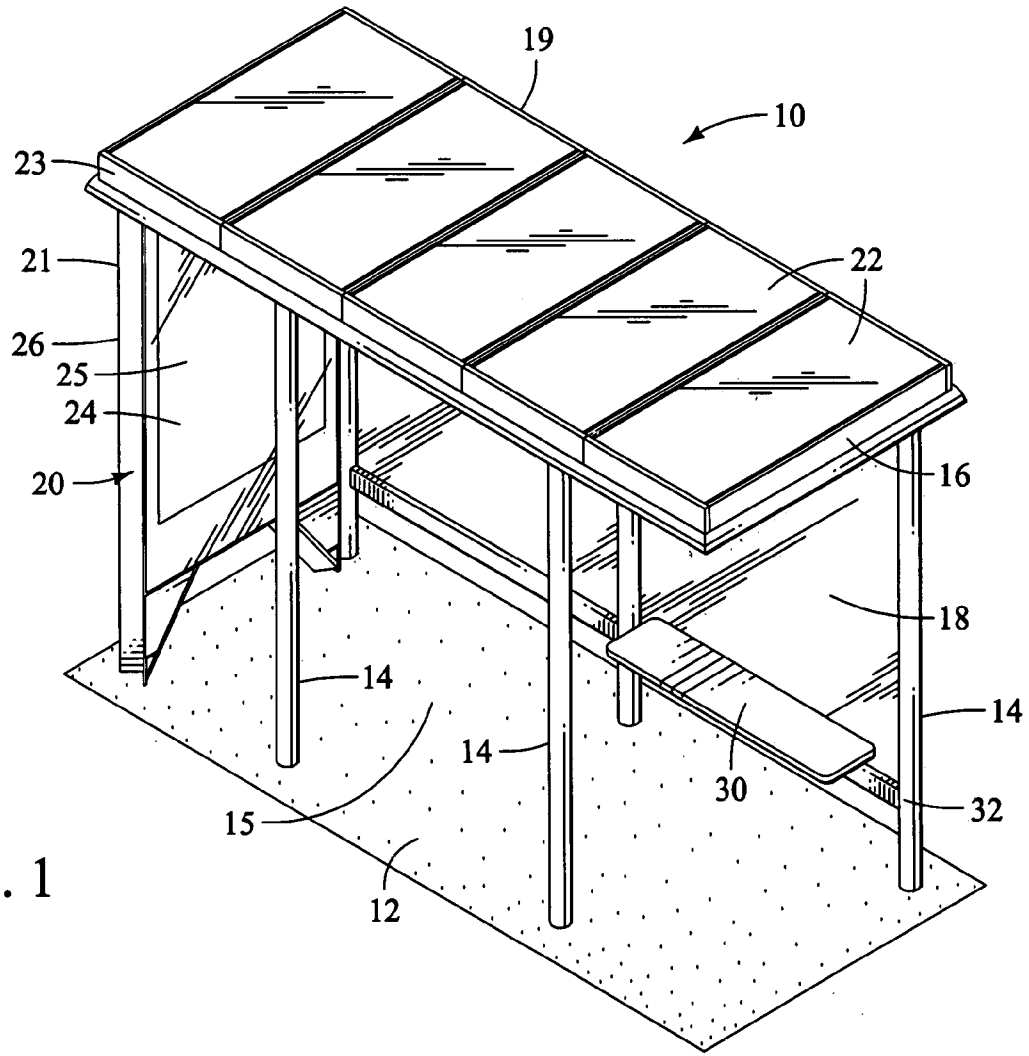
FIG. 1 is a perspective view of a preferred embodiment of the shelter according to the present invention.

A preferred embodiment of the invention is shown as a transit shelter 10 mounted on a foundation 12. The shelter 10 includes a plurality of upstanding posts 14, a roof structure 16, a first wall 18, and a wall module 20. A spatial area 15 is defined therein, as shown in FIG. 1. The wall module 20 is preferably a separate structure from the remaining components of the shelter 10, and may be essentially free standing, separate from the rest of the shelter 10. The roof structure 16 may further include a plurality of photovoltaic solar panels 22. The wall module 20 may further comprise an advertising display having a first side 25 and a second side 26 wherein the advertising may be posted and protected from the elements. The advertising may also be illuminated from within the wall module 20 by power supplied from the photovoltaic solar panels 22 (described below). The shelter 10 may also include a bench 30 and a plurality of horizontal supports 32. As shown and described herein, the shelter 10 is a generally rectangular structure, however, the figures are not meant to be limiting and the shelter 10 may comprise a variety of shapes and sizes, such as curved shapes, semicircular enclosures, etc.

In a preferred embodiment of the present invention, the shelter 10 may withstand hurricane force winds, for example, withstanding wind speeds of up to about 146 mph. The specifications for the elements described herein are made with reference to a particular embodiment of the shelter 10. Of course, one skilled in the art will recognize that the shelter 10 may also be constructed as described herein with materials adapted for non-hurricane type conditions. However, the structural characteristics of the present design are desirable for any application where a durable, strong, wind-resistant shelter is required.

As shown in FIG. 1, the spatial area 15 of the shelter 10 is protected from a substantial amount of wind and rain on two sides by the wall 18 on a first side 19 and the wall module 20 on a second side 21 and from above by the roof structure 16. Additional walls 18 or wall modules 20 or both may be used for protection of the spatial area 15 of the shelter 10. Alternatively, the spatial area 15 may be protected by the wall 18 or the wall module 20 on one side and from above by the roof structure 16.

Figure 4:
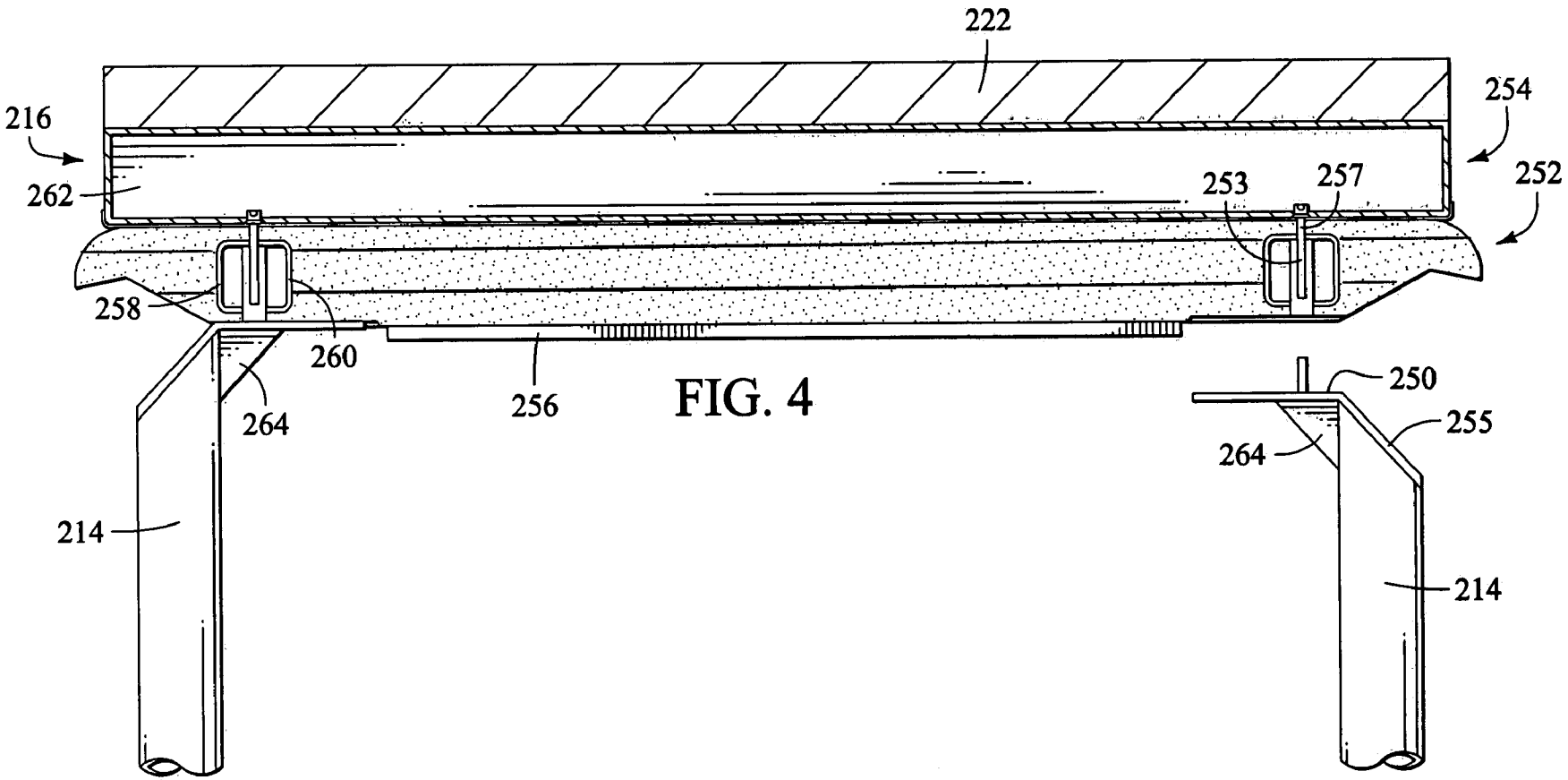
FIG. 4 is a partial view of an alternative roof structure of the preferred embodiment shown in FIG. 1.

In the preferred embodiment, the roof structure 16 is supported by a plurality of posts 14. In a preferred embodiment of the present invention, the upstanding posts 14 support the roof structure 16 on the first side 19 and on an opposing third side 23 of the shelter 10. More preferably, the posts 14 support the roof structure 16 wherein the posts are in non-symmetrical positions with respect to the first side 19 and the third side 23 of the shelter 10. As shown in FIG. 1, three posts 14 support the first side 19 of the roof structure 16 having one post 14 at approximately each corner of the first side 19 of the roof structure 16 and one post 14 approximately centrally positioned on the first side 19 of the roof structure 16 with respect to the two posts 14 positioned approximately at the corners of the first side 19. On the third side of the shelter 10, in a preferred embodiment, two spaced apart posts 14, offset from the front corners of the roof structure 16, may be used to support the third side of the roof structure 16. As shown in FIG. 4, the perimeter of the roof structure 16 extends beyond the posts 14. Of course, other configurations and numbers of the posts 14 are possible to support the roof structure 16. The roof structure 16 may also be mounted to any supports known to one of skill in the art and the supports are not limited to the exemplary posts described herein. Indeed, strong wall structures may be substituted for more posts.

Figure 2A:
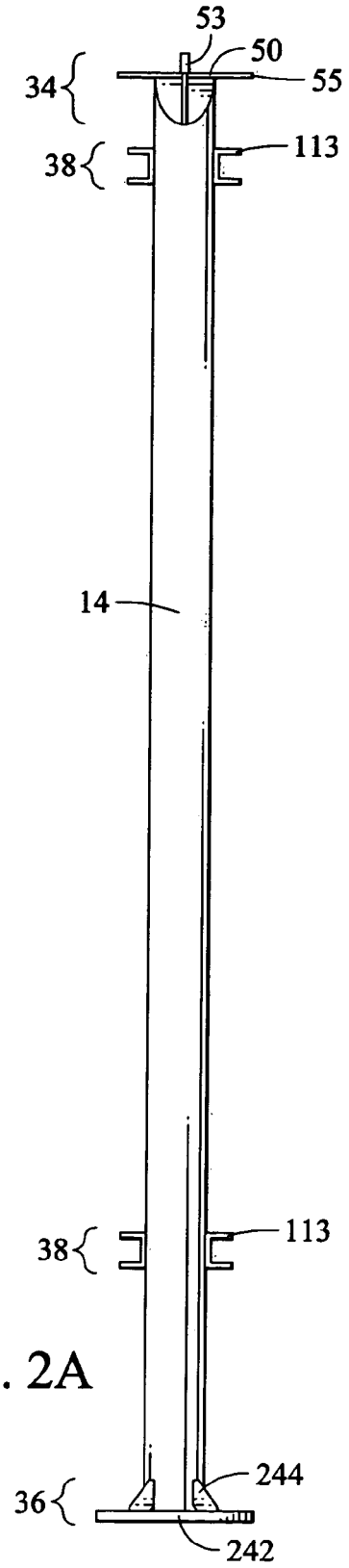
FIG. 2A is a front plan view of a post of the preferred embodiment shown in FIG. 1.
Figure 2B:
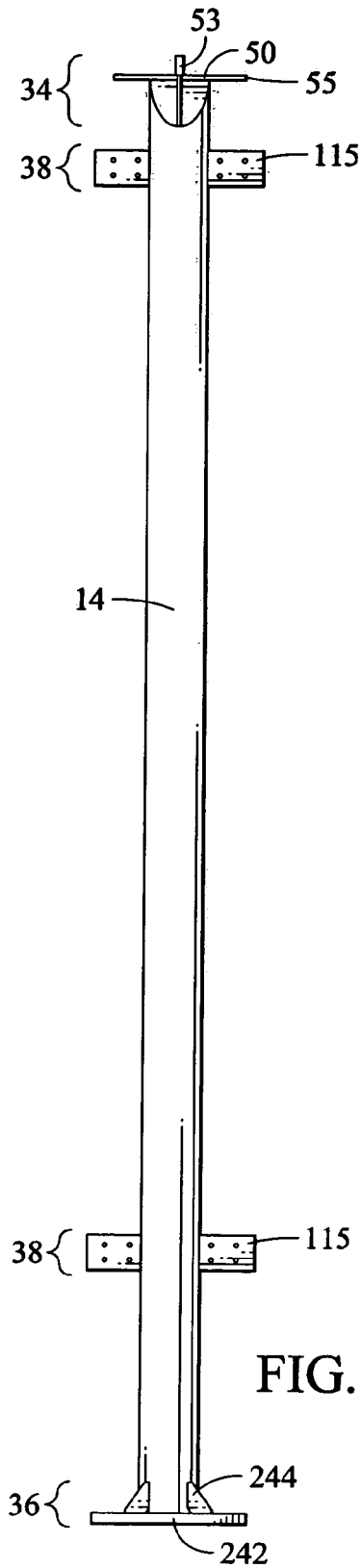
FIG. 2B is an a front plan view of an alternate embodiment of the post shown in FIG. 2A.

An exemplary post 14 is shown in FIGS. 2A and 2B. The post 14 may further comprise a plurality of attachments, including roof structure attachments 34, foundation attachments 36 and panel support attachments 38. Each of the attachments 34, 36 and 38 will be discussed below in greater detail with reference to the elements connected via the attachments 34, 36 and 38. Skilled artisans will recognize that variations in the attachments on the posts 14 will depend on the placement of the posts 14 in the shelter 10 and not every post 14 will comprise all the attachments 34, 36, and 38. In a preferred embodiment, the plurality of posts 14 comprise 4 inch (nominal) steel pipe posts, made of AISI 304 series stainless steel, having a minimum yield strength of about 42 ksi. However, other sizes and materials may be used. Other details of FIGS. 2A and 2B are discussed below.

Figure 3:
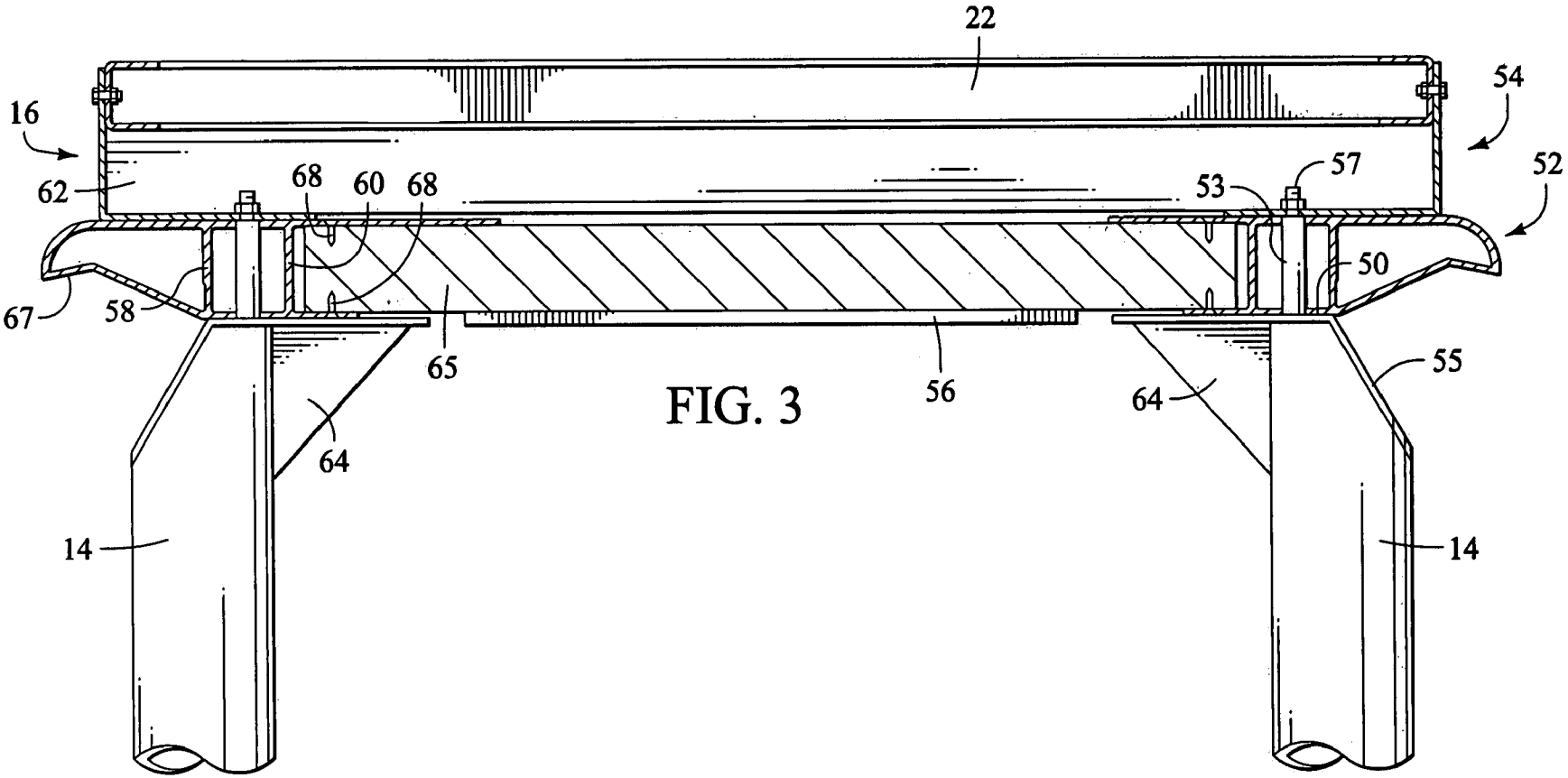
FIG. 3 is a partial view of a roof structure of the preferred embodiment shown in FIG. 1.

As shown in FIG. 3, the roof structure 16 of a preferred embodiment further comprises a roof panel 52, a roof frame 54, and the plurality of solar panels 22. Additionally, the roof structure 16 may further comprise a light source 56 for illumination of the spatial area 15 defined within the shelter 10. The roof panel 52 and the roof frame 54 may be secured to each of the plurality of the posts 14 by any means known to one of skill in the art. By way of example, the roof panel 52 and the roof frame 54 may be secured to each of the posts 14 via roof attachments 34. Roof attachment 34 includes a post cap 50 and a sleeve 53 extending axially from the post 14 and the post cap 50 as shown in FIGS. 2A, 2B and 3. Each post cap 50 further comprises a flange 55 extending radially beyond the perimeter of the post 14. The flange 55 may be angled, as shown in FIG. 3. A securing fastener 57 engages the sleeve 53 and secures the roof structure 16 to the posts 14. The roof attachment 34 may further include a brace 64 for further support of the frame 54.

As shown in FIG. 3, the roof panel 52 may comprise a panel 65 attached to a support frame 67. In a preferred embodiment, the support frame 67 may be formed from extruded aluminum and secured to the panel 65 using fasteners 68. By way of example, the fasteners 68 may be screws or rivets. The support frame 67 may further comprise a plurality of recesses 58 that may be formed integrally with the support frame 67. In an alternative embodiment, the recesses 58 may be formed from a separate tube, preferably aluminum, which is attached to the support frame 67. The plurality of recesses 58 formed in the roof panel 52 are adapted to receive the plurality of post caps 50 and a plurality of roof supports 90 or 92 or both, as described below. As shown in FIG. 3, an open space 62 is formed between the roof panel 52 and the plurality of solar panels 22 to allow for air to flow through the shelter 10. Other open spaces may be defined. In a preferred embodiment of the present invention, to ensure further hurricane-force wind resistance, the post caps 50, the flanges 55 and the braces 64 are made of stainless steel, AISI 304 series, having a minimum yield strength of about 42 ksi. Of course, other acceptable alternative materials may be used. The preferred sleeve 53 may be welded to the cap 50, or may be threaded, and may have about 0.394 (nominal) inch inner diameter× 1.57 inch length, and about 0.591 (nominal) inch outer diameter. The preferred fastener 57 comprises a 0.394 (nominal) inch×3.19 inch machine screw, AISI 304 or 316 series stainless steel, with a minimum shear strength of about 60 ksi and a minimum tensile strength of about 90 ksi. Alternatively, the fastener 57 may be a threaded rod, a washer and a nut. Of course, other acceptable alternative securing elements and materials may be used.

The panel 65 of the roof panel 52 may be made from suitable materials known to those of skill in the art, including but not limited to materials such as aluminum, steel, synthetic composites, polymers and combinations of materials thereof. In a preferred embodiment, shown in FIG. 3, the panel 65 comprises an insulated aluminum panel. By way of example, but not limited to the following, the panel 65 may be formed from expanded polystyrene, more preferably, about 3 inch thick 1 pound per cubic foot density expanded polystyrene. The polystyrene is available from Apache Products Company, Meridian, Miss. The roof panel 52 further comprises an aluminum skin. A preferred embodiment comprises aluminum skin having about 0.035 inch thickness, stucco embossed (3003-H154) aluminum having a minimum yield strength of about 28 ksi top and bottom. The polystyrene and the aluminum skin are adhered together with a urethane prepolymer solution, preferably with solution MOR-AD M464, available from Morton International, Inc., Chicago, Ill.

In an alternative embodiment, shown in FIG. 4, the roof structure 216 further includes a roof panel 252, a roof frame 254, and the plurality of solar panels 222. Additionally, the roof structure 216 may further comprise a light source 256. The roof panel 252 and the roof frame 254 may be secured to each of the plurality of the posts 214 by any means known to one of skill in the art. As shown, the post 214 is secured via post cap 250. The post cap 250 further comprises a flange 255 extending radially beyond the perimeter of the post 214. The flange 255 may be angled, as shown in FIG. 4. A securing fastener 257 engages the sleeve 253 and secures the roof structure 216 to the posts 214. The roof attachment may further include a brace 264 for further support of the frame 254.

The roof panel 252 may comprise a plurality of layers of composite polymer material. The recesses 258 may be formed within the composite material. By way of example, but not limited to the following, the roof panel 252 may be formed from three layers of rigid extruded polystyrene, each layer of the polystyrene is impregnated with a resin, and each of the resinated polystyrene layers is laminated with a polyurethane adhesive. More preferably, the roof panel 252 may be comprised of a composite polymer material of 2.2 pounds per cubic foot density comprising three layers of extruded rigid polystyrene having 1.5 pounds per cubic foot density. The composite material is available from Dow Chemical, Midland, Mich. The composite material is wrapped with polycor ISO PA gel coat fiberglass, with 73 pounds per cubic foot density, reinforced by impregnating the wrapped composite material with about 0.03 inch thick Estratil® 2521 C polyester resin with 107 pounds per cubic foot density. The extruded polystyrene resinated layers are laminated between each layer with polyurethane adhesive comprising macroplast UR 8103 resin (94 pounds per cubic foot density), mixed with UR 5400 hardener (75 pounds per cubic foot density) at a 4:1 ratio by weight. The polyurethane components are available from Henkel/Berich S.A., Barcelona, Spain. These materials provide sufficient strength and light weight.

Figure 5:
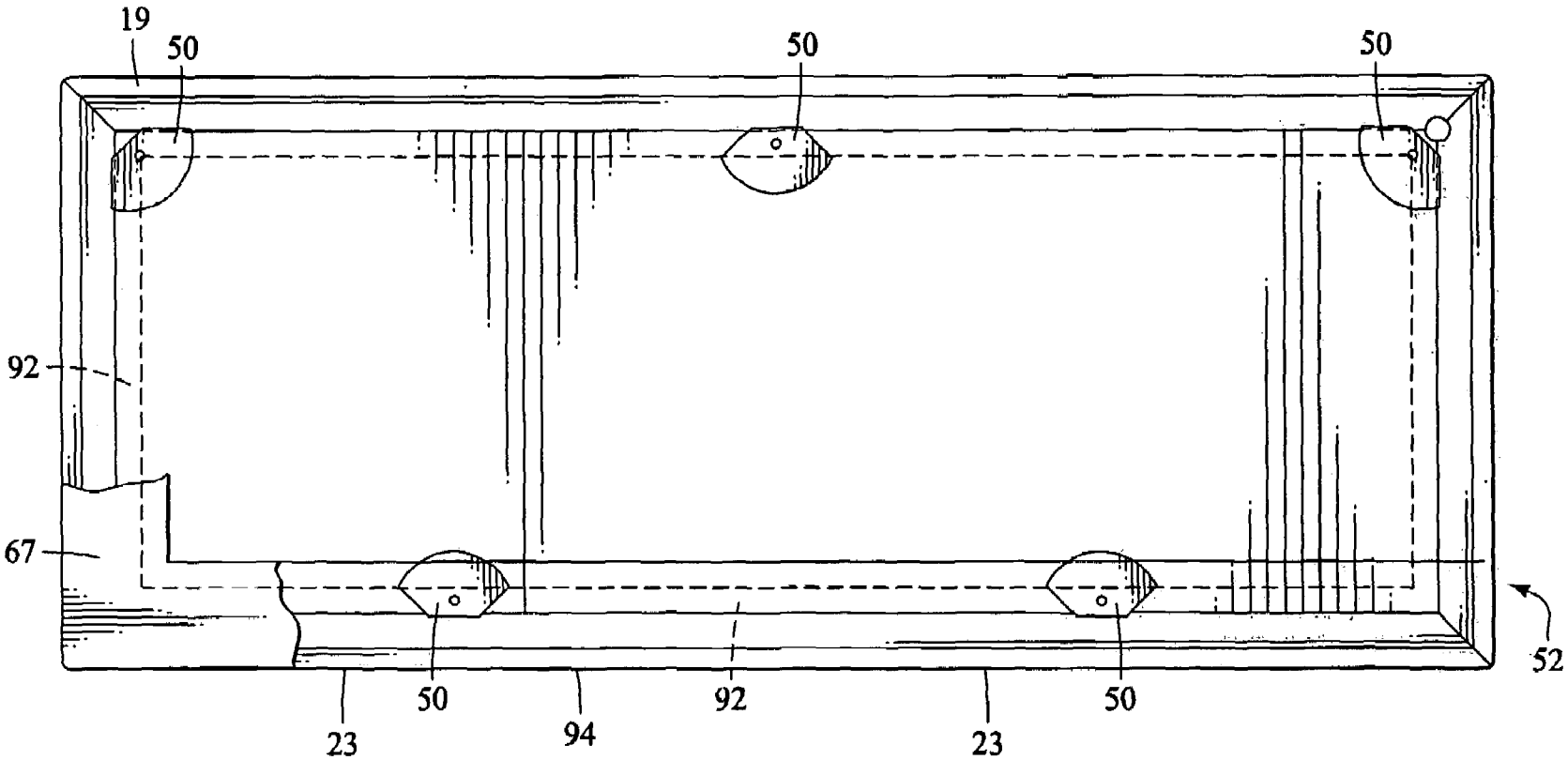
FIG. 5 is a partial bottom view of the roof structure of the preferred embodiment shown in FIG. 3.

As shown in FIG. 5, the roof panel 52 comprises a plurality of horizontal roof supports 92 which form a generally rectangular support structure for the roof panel 52. The roof supports 92 connect to the posts 14 at the post cap 50. The supports 92 may be formed from aluminum tubing, however, any suitable material known to one of skill in the art may be used. The roof panel 52 may further comprise a support frame 67 formed from a sheet metal skin that surround the perimeter of the roof panel 52. The skin 67 may be about 0.09 inches thick. Alternatively the frame 67 may be formed from extruded aluminum as described above for FIG. 3. Preferably, the aluminum extrusions described herein shall be made of a minimum aluminum association alloy and temper corresponding to 6063-T6. In addition, aluminum extrusion in contact with steel may be protected by applying a paint, preferably Koppers bituminous paint.

Figure 6:
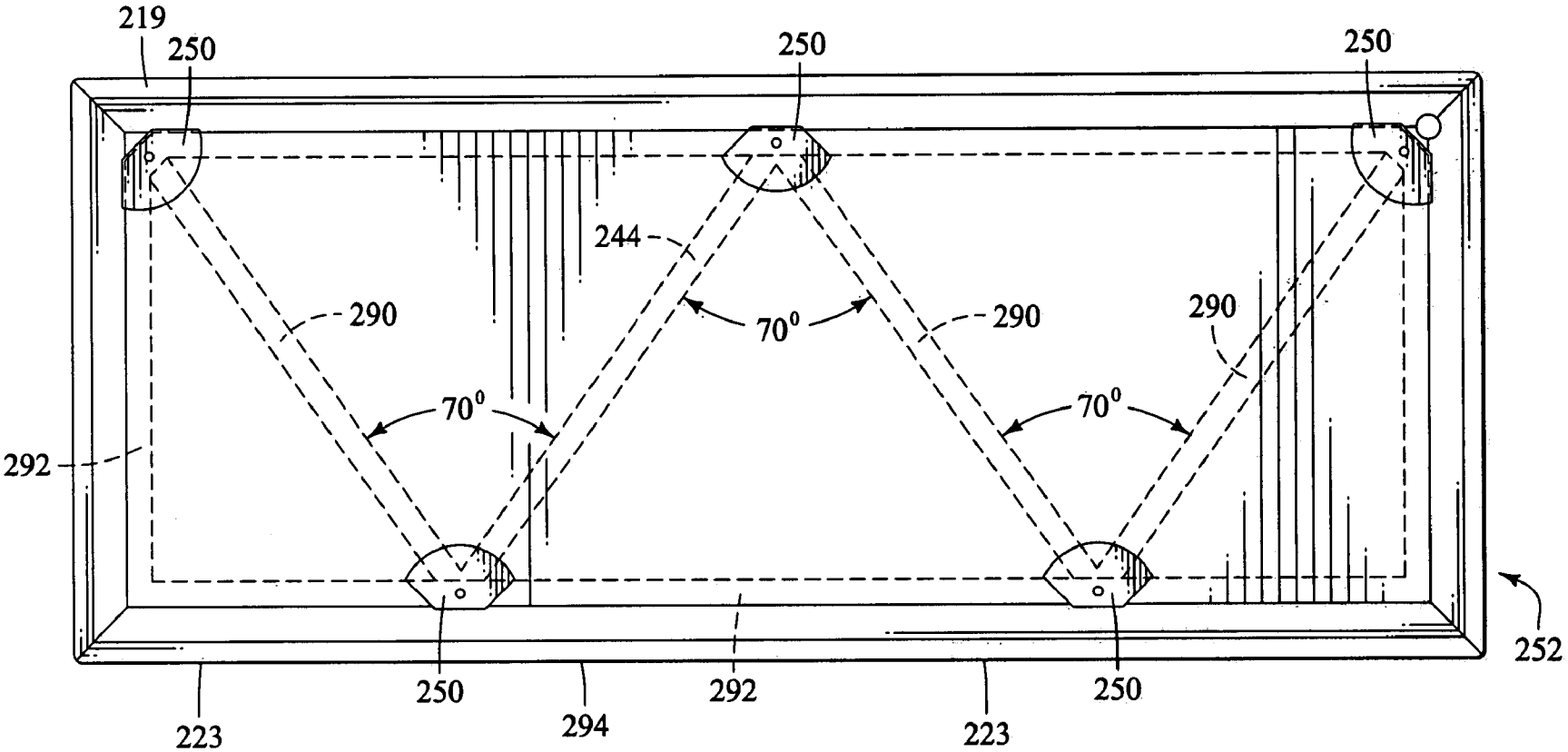
FIG. 6 is a partial bottom view of the roof structure of the alternative embodiment shown in FIG. 4.

In an alternative embodiment, shown in FIG. 6, the roof panel 252 further comprises a plurality of reinforcing horizontal roof supports 290 connected to the plurality of posts 214 as shown in FIG. 4. Each roof support 290 connects to a pair of posts 214, one post 214 on the first side 219 of the shelter and one post 214 on the third side 223 of the shelter, thereby forming diagonally extending supports for the roof panel 252 with respect to the first side 219 and the third side 223 of the shelter. The diagonal supports 290 preferably form an angle of approximately 70° between adjacent supports 290. Additional supports 292 connect the posts 214 forming a generally rectangular composite support structure for the roof panel 252, recessed from the edge 294 of the roof structure 216, and generally following the contour of the roof structure 216, as shown in FIG. 4. The roof supports 290 and 292 are positioned within the recesses 258 in the roof panel 252. By way of example, in the alternative embodiment, the roof supports 290 and 292 may be formed from steel square tubes having a minimum yield strength of about 30 ksi. The preferred tubes may be approximately square having sides of about 3.15 inches and a thickness of about 0.197 inches. The roof support 290 and 292 may be welded circumferentially and welded to the posts 214. The welding of the roof supports 290 and 292 will be performed in accordance with the American Welding Society AWS D.16 regulations.

Figure 7:
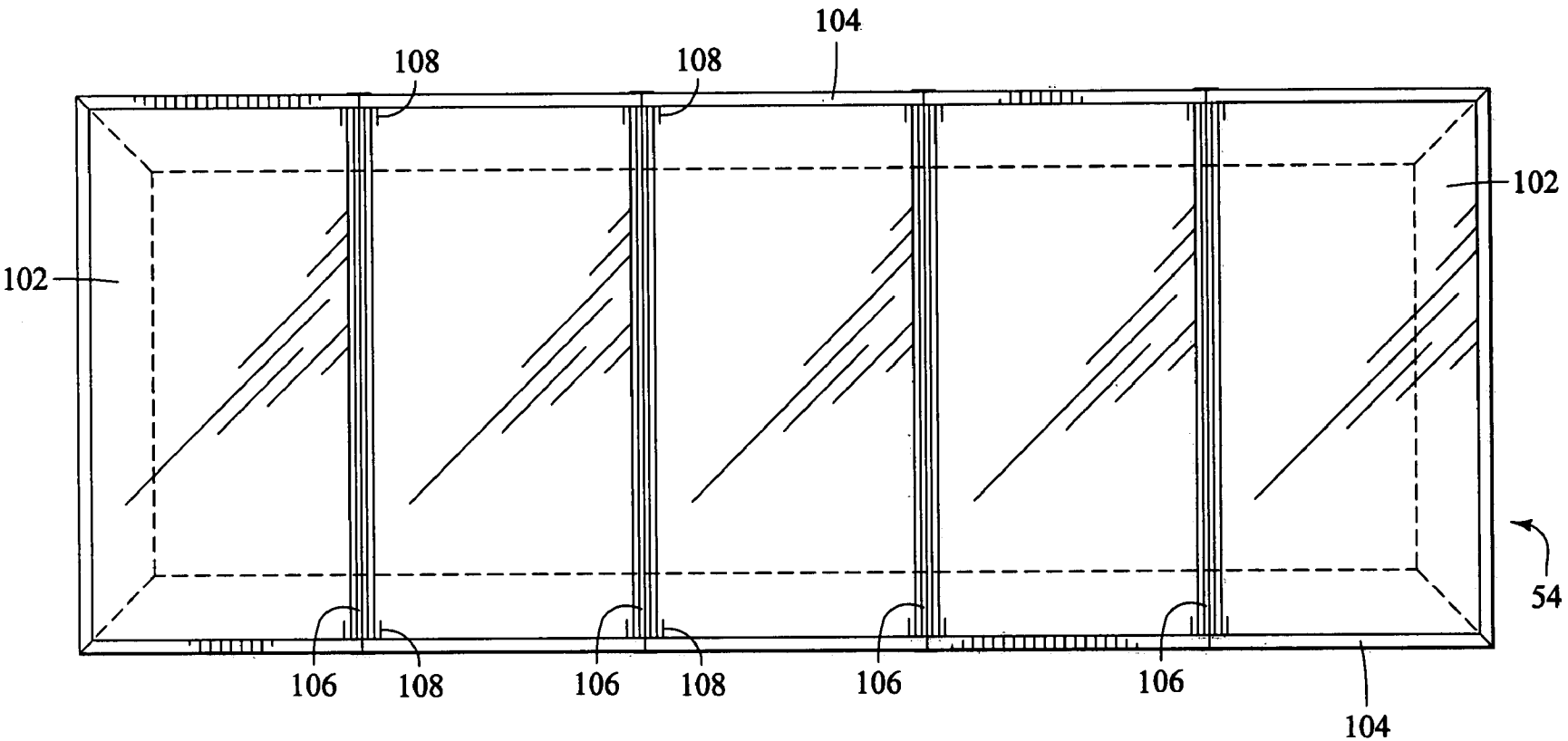
FIG. 7 is a partial top view of the roof structure of the preferred embodiment shown in FIG. 1.

FIG. 7 illustrates the roof frame 54 for the solar panels 22. As shown in FIG. 3, the frame 54 is secured to the roof panel 52 by the securing elements 57. The frame 54 comprises a generally rectangular-shaped frame having a pair of lateral frame plate supports 102 at each side of the frame 52 and a pair of plate supports 104 extending perpendicularly from the pair of supports 102. The frame 54 further comprises a plurality of lateral cross-member supports 106 extending between the plates 104 and substantially parallel to the plates 102. The supports 106 may support a plurality of solar panels 22. The number of supports 106 will vary depending on the number of solar panels 22 attached to the frame 54.

In an embodiment of the present invention, the supports 102 may be formed from stainless steel, AISI 340 series with a minimum yield strength of about 42 ksi. The supports 102 may further comprise an L-shaped plate having a thickness of about 0.12 inches and welded to about a 0.98 inch bent U-shaped channel. The supports 102 may have a plurality of perforations formed in the L-shaped profile. The preferred plates 104 are formed from stainless steel, AISI 340 L series, with a minimum yield strength of about 42 ksi and having an L-shaped plate with a thickness of about 0.12 inches and welded to about a 0.98 inch U-shaped bent channel. The supports 106 preferably are formed from stainless steel, AISI series 340, with a minimum yield strength of about 42 ksi and having thickness of about 0.984 inches. The plate supports 102,104 and 106 may be attached using welding, machine screws and bolts, and rivets. Additionally, a plurality of gussets 108 may be attached to the plate 104 where the supports 106 meet the plates 104. The welding as described herein shall be performed in accordance with the American Welding Society AWS D1.6 regulations. The preferred machine screws and bolts as used herein comprise AISI 304 or 316 series stainless steel with a minimum shear strength of about 60 ksi and a minimum tensile strength of about 90 ksi. The rivets are preferably made from stainless steel with a minimum of 550 lb. shear strength and 700 lb. minimum tensile strength. Other suitable materials may be used.

Figure 8:
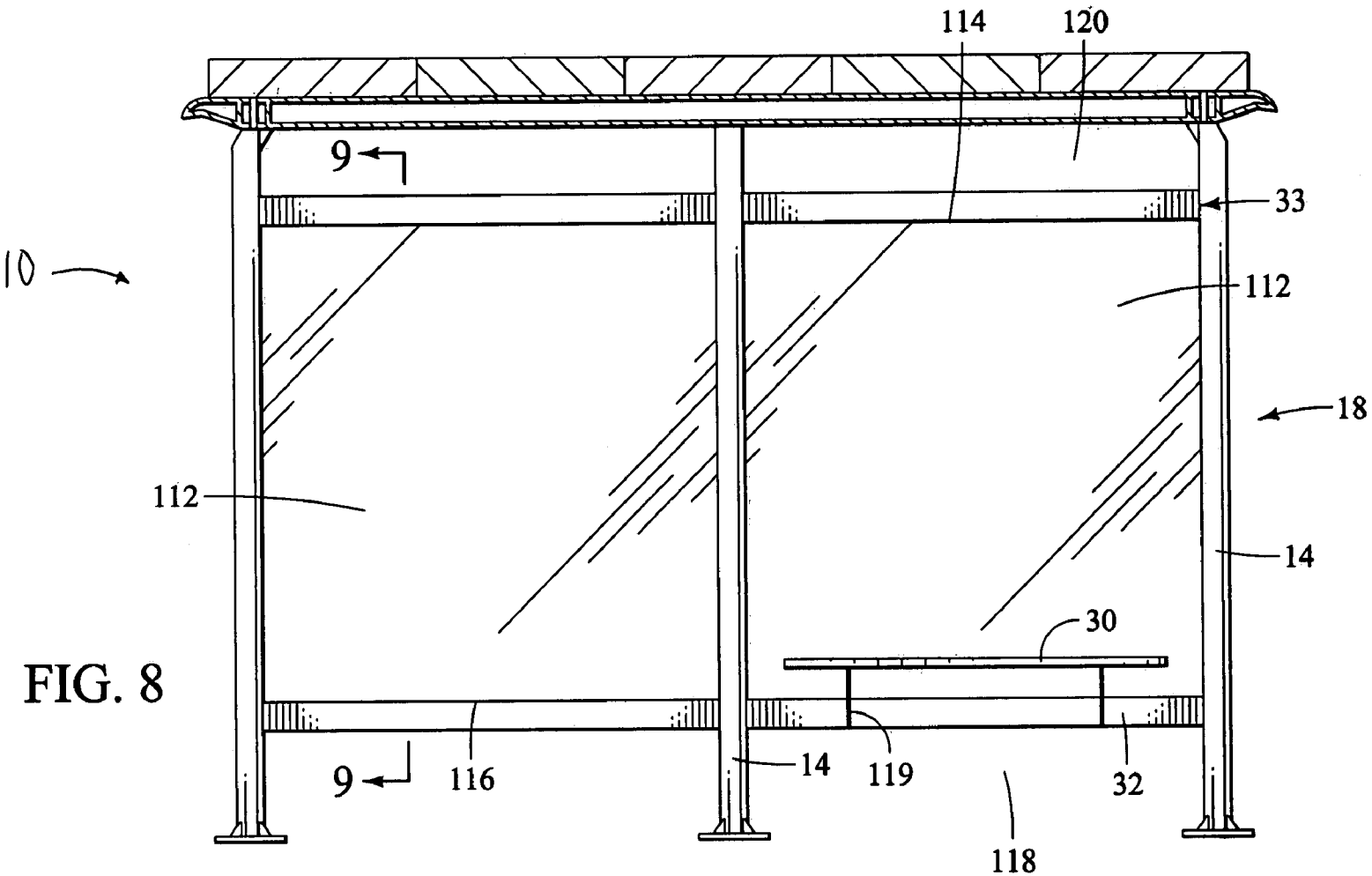
FIG. 8 is a front plan view of a wall of the preferred embodiment shown in FIG. 1.

FIG. 8 illustrates the wall 18 of the shelter 10 which spans at least one pair of posts 14. The wall 18 provides protection of the spatial area 15 for the waiting passengers from the elements. A plurality of walls 18 may also be used to provide additional protection. For example, the walls 18 may extend approximately perpendicularly with respect to each other or the walls 18 may be parallel with respect to each other, and the freestanding panel 20 providing addition protection for the spatial area 15. Alternatively, freestanding wall modules 20 may be used to provide protection instead of the walls 18 (not shown).

In a preferred embodiment, the wall 18 comprises a plurality of vertical panels 112. The vertical panel 112 is preferably formed from glass, more preferably a tempered glass panel about 10 mm thick, preferably having ground edges. The plurality of vertical panels 112 are at least partially captured on their edges by a plurality of horizontal panel support members 32 and 33. The plurality of panel support members 32 and 33 for mounting the plurality of vertical panels 112 are connected to span the posts 14. Preferably for each panel 112, one of the plurality of the support members 33 spans the top 114 of the vertical panel 112 and one of the plurality of the horizontal support members 32 spans the bottom 116 of the vertical panel 112. As shown in FIGS. 2A and 2B, the posts 14 may comprise panel support attachments 38. The panel support attachments 38 include a plurality of projections 113, 115 adapted to engage the support members 32 and 33. As shown in FIG. 2A, the support attachments 38 include a plurality of c-shaped projections 113 extending radially from the post 14. The projections 113 are adapted to engage the panel support members 32 and 33 by slidably engaging the interior of support members 32 and 33 and preferably being welded to the support members 32 and 33. As shown in FIG. 2B, alternative projections 115 are adapted to engage the support members 32 and 33 by slidably engaging the support members 32 and 33 within a recess formed within the panel support members 32 and 33 or by engaging an exterior surface of the panel support members 32 and 33 and secured thereto with an attachment such as screws or rivets. The connection between the posts 14 and the support members 32 and 33 may be any connection means known to one of skill in the art.

Each post 14 connected to the horizontal support members 32 and 33 includes the projections 113,115 extending radially from the post 14. The number of projections 113,115 per post 14 will vary based on the number of panel support members 32 and 33 connected to the post 14. Preferably, each post on the first side 19 of the shelter 10 will have at least two projections 113, 115 corresponding to the support members 33 and 32 positioned on the top 114 and the bottom 116 of the vertical panel 112, respectively. In a preferred embodiment, the projections 113,115 are formed from stainless steel, AISI 304 series.

Figure 9:
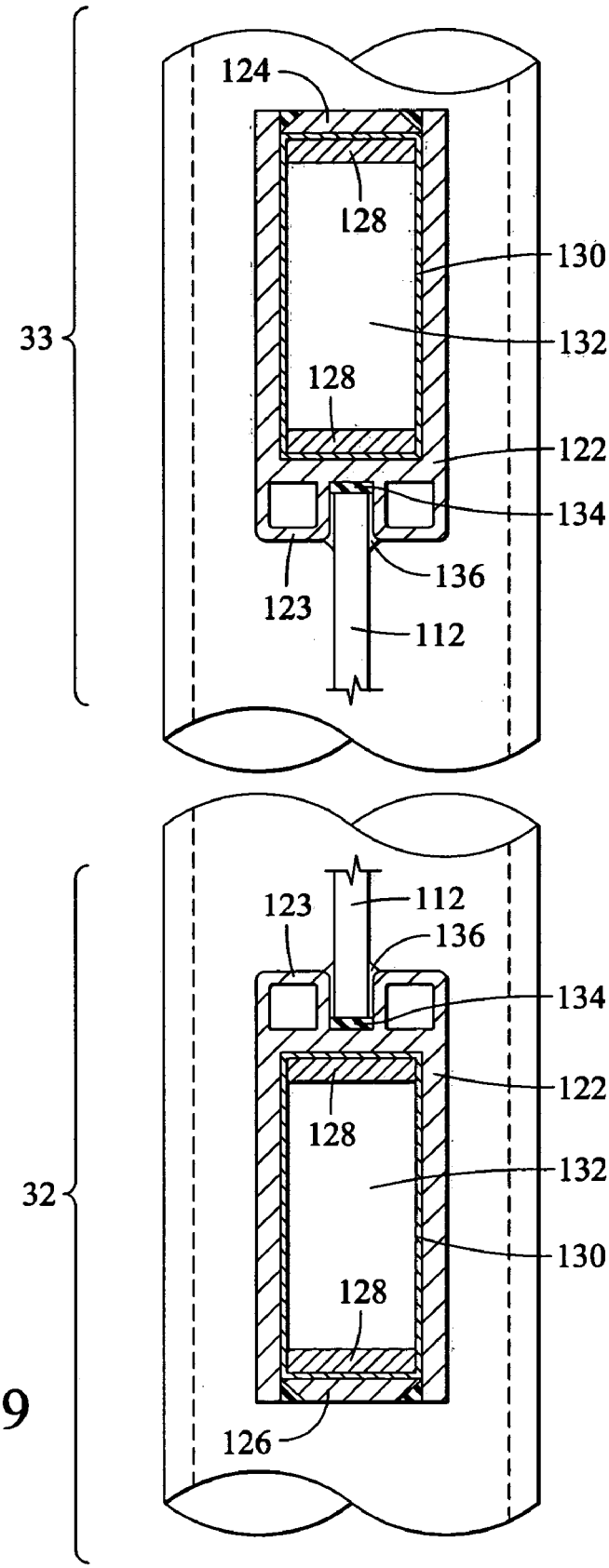
FIG. 9 is a cross-sectional view of an embodiment of the wall shown in FIG. 8.

As shown in FIG. 9, a plurality of open spaces 118 and 120 are defined above and below each mounted vertical panel 112, respectively. The open spaces 118 and 120 allow for air flow around the wall 18. This decreases the amount of stress borne by the shelter 10 and the wall 18 during high winds.

A cross-sectional view of a preferred embodiment of the wall 18 and its support members 32 and 33 is shown in FIG. 9. Each of the plurality of support members 32 and 33 may further include a rail structure 122. The rail structure 122 forms a framework upon which additional supports may be added in the preferred embodiment of the present invention. In a preferred embodiment, shown in FIG. 9, the rail structure 122 further includes a plurality of reinforcing knuckles 123 formed in the corners of the rail structure 122 surrounding the panel 112. The rail structure 122 further comprises a notched top flange 124 and a notched bottom flange 126. The flanges 124 and 126 are adapted to fit panel support attachments 38 of the post 14. Preferably, the support members 32 and 33 are welded to the attachments 38 at 128. Silicone 130 surrounds the interior channel 132 formed in the support members 32 and 33. A gasket 134, preferably formed from neoprene, engages the panel 112 between the knuckles 123. Silicon 136 contacts the panel 112 from the gasket 134 and along the knuckles 123. The rail support 122 may be formed from extruded aluminum, an aluminum tube, or any other material known to one of skill in the art. The knuckles 123 may be formed integrally with the extruded aluminum or the knuckles 123 may be formed separately from aluminum or from stainless steel bent plate channels and attached to the rail support 122, preferably by welding.

Figure 10:
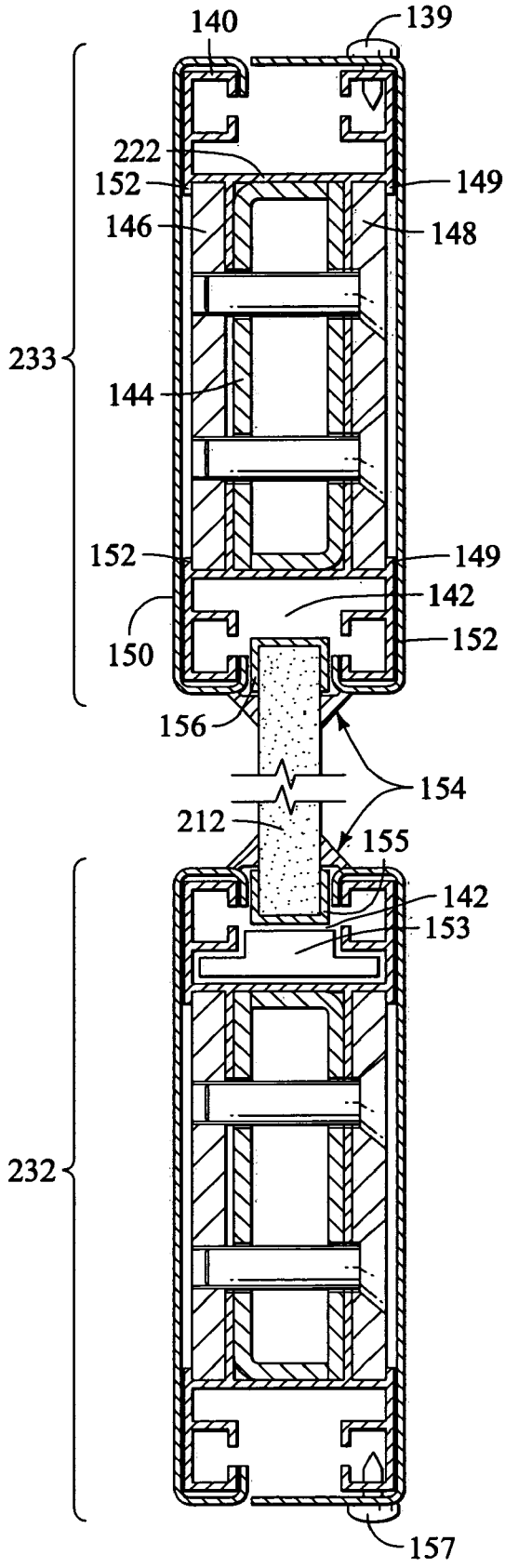
FIG. 10 is a cross-sectional view of an alternative embodiment of the wall shown in FIG. 8.

In an alternative embodiment shown in FIG. 10, the rail structure 222 framework includes a plurality of reinforcing knuckles 140 formed in each corner of the rail structure 222. The reinforcing knuckles 140 of the rail structure 222 further create a channel 142 that may also be used to provide support for the panel 212. Each support member 232 and 233 may further include a reinforcing tube 144 sized to fit within the rail structure 222 and extend the length of the rail structure 222. Additionally, a rear reinforcing plate 146 and a front reinforcing plate 148 may be included, the plates 146 and 148 may be adapted to engage protrusions 149 formed in the framework of the rail structure 222 in the front and back of the rail structure 222, respectively, and extend the length of the rail structure 222. Claddings 150 and 152 may be added to the exterior of the front and the back of the panel support members 232 and 233, respectively. Alternative supports may be used for the panel support 32 when the bench 30 is connected with the panel support 32. In addition, a glass support 153 connected with the support member 232 may be used to support the panel 212. A gasket flange 155 engages the panel 212 and tightly secures the panel 212 in the channel 142 formed by the reinforcing knuckles 140.

The rail structure 222 may be an extruded rail formed from aluminum alloy having a minimum thickness of about 0.059 inches. The reinforcing tube 144 may be formed from stainless steel, AISI 304 series, having a thickness of about 0.118 inches. The tube 144 may be formed from two L-shaped plates welded together, meeting the welding specifications described above and having a minimum yield strength of about 30 ksi. The front and rear reinforcing plates 146 and 148 may be formed from stainless steel, AISI 304 series with a minimum yield strength of about 42 ksi. The claddings 150 and 152 may be formed from polished stainless steel, AISI 304L series, having a thickness of about 0.039 inches with a minimum yield strength of about 30 ksi. The claddings 150 and 152 may be attached to the rail structure 222 with rivets 157. The rivets 157 may preferably be formed from stainless steel with a minimum of 550 lb. shear strength and 700 lb. minimum tensile strength. The glass supports 153 may be formed from two A 42 galvanized steel plates, preferably welded together to form the glass support 153.

As shown in FIG. 10, the panel 212 is engaged with the gasket flange 155 and positioned within the channel 142. The flange 155 may be formed from neoprene rubber having a thickness of 0.047 inches. Preferably, the gasket flange 155 is cut after the panel 212 is set to achieve about a 7/16 glass bite 154 to together hold the panel 212 in place in the channel 142 of the rail support 222. A sealant 156 is applied to the panel 212 and the bite 154 once the panel 212 and the bite 154 are engaged with the rail structure 222. A preferred sealant 156, is DOW 912 available from Dow Chemical, Michigan, USA. However, any sealant known in the art may be used to provide a protective seal around the panel 212.

The wall 18 may further include a bench 30 mounted adjacent thereto, as shown in FIG. 8. The bench 30 may be connected with the panel support member 32 of the shelter 10. A plurality of brackets 119 may be used to support the bench 30. The bench 30 may be formed from any material adapted to form a bench, including, but not limited to composite materials, wood and metal. In a preferred embodiment, the bench 30 is formed from steel, preferably ASTM A-1011 hot rolled steel with a minimum yield strength of about 40 ksi. Further, the bench may be painted and coated with PVC coating, preferably with denflex PX-12412 PVC plastisol coating, about 0.125 inches thick (available from Polyone, Chicago, Ill.) having 10.4 pounds per gallon density, about 2300 psi tensile strength (ATSM D-412) and about 419 ppi tear strength (ATSM D-624). The bench brackets 119 are preferably formed from stainless AISI 304 series steel. The bench 30 may be attached to the panel support 32 by welding, bolting, screwing, or riveting, or a combination thereof.

Figure 12:
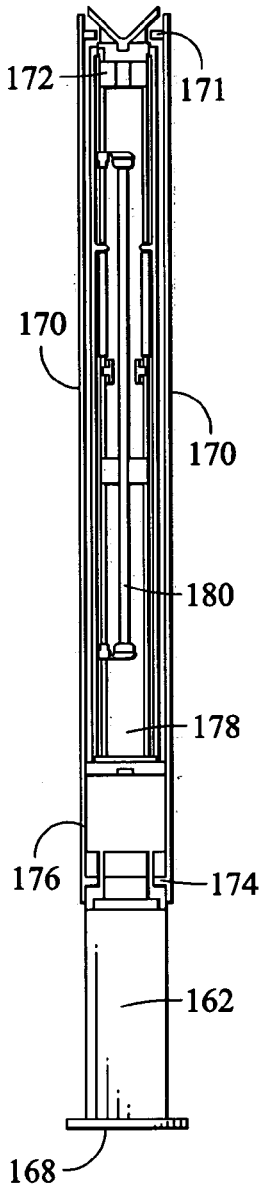
FIG. 12 is a cross-sectional view of the wall module shown in FIG. 11.
Figure 11:
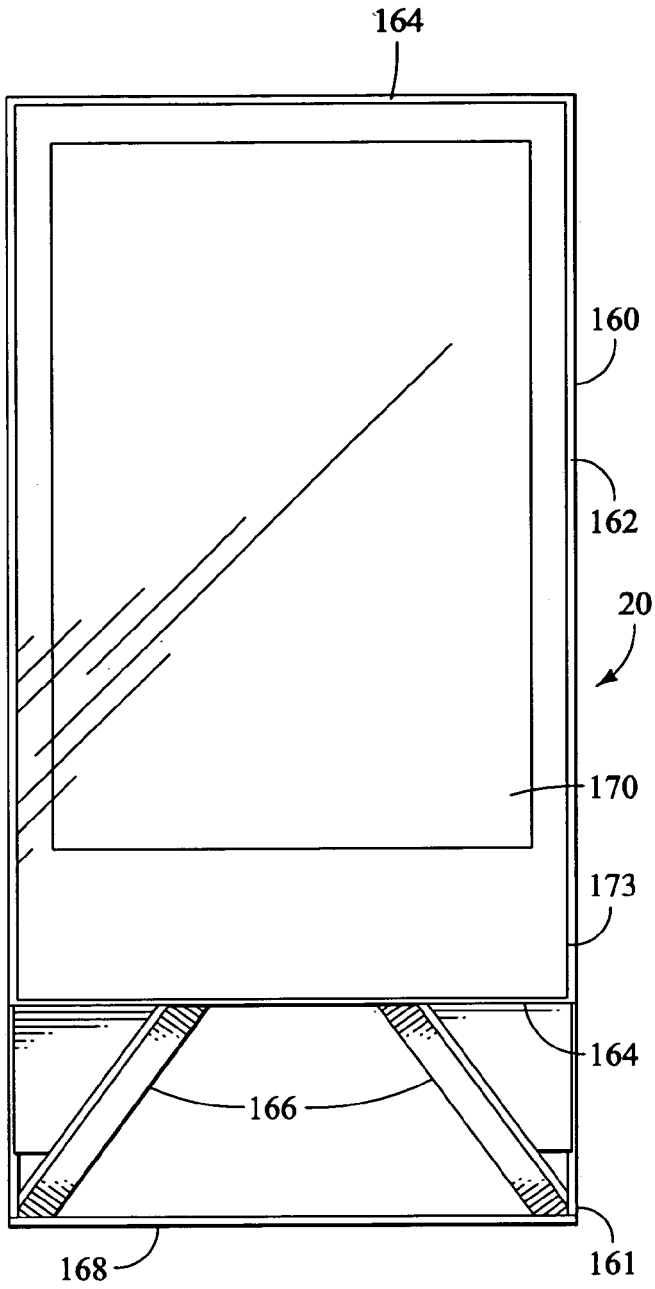
FIG. 11 is a front plan view of a wall module of the preferred embodiment shown in FIG. 1.

FIGS. 11 and 12 illustrate the wall module 20. The wall module 20 is a freestanding panel that provides protection together with the structurally separate wall 18 and the roof structure 16 of the shelter 10 shown in FIG. 1. The wall module 20 and the wall 18 may be secured to a common foundation 12. In a preferred embodiment of the present invention, the wall module 20 itself is designed to withstand the hurricane force winds up to about 146 mph. However, one of skill in the art will recognize that the wall module 20 may also be designed for use as a free standing protective panel for the shelter 10 for any application where a durable, strong, wind-resistant shelter is needed. The freestanding wall module 20 is positioned adjacent to at least one of the posts 14 and has a space defined between the post 14, the roof structure 16 and the wall module 20 that allows for air to pass around the panel 20. Also, wind vibration of the module 20 may be isolated from the wall 18 and the roof structure 16 of the remainder of the shelter 10 and vice versa. In a preferred embodiment of the present invention, the freestanding wall module 20 is positioned to provide protection to the spatial area 15 by extending approximately perpendicularly to the wall 18, having one side edge 161 extending parallel to the wall 18. The module 20 may also be positioned at least partially beneath the roof structure 16. Alternatively, the wall module 20 may be positioned parallel to and spaced apart from the wall 18 to provide protection for the spatial area 15. In other contemplated configurations, a plurality of freestanding wall modules 20 may be assembled and isolated from the roof of the structure and its supporting posts to provide shelter without transmitting vibration to the roof.

The wall module 20 in the preferred embodiment includes a frame 160 comprising a pair of substantially vertical panel supports 162, a pair of substantially horizontal panel supports 164, a pair of structural braces 166, and a base plate 168. The frame 160 of the module 20 does not attach to the roof structure 16 or the wall 18 of the shelter 10. The supports 164 of the frame 160 may be secured directly to the foundation 12. The frame 160 is preferably formed from flattened steel, including the vertical supports 162. Alternatively, the vertical supports 162 of the frame 160 may include structures similar to the posts 14 as described above.

The wall module 20 further includes a pair of transparent panels 170 attached to the frame 160. The panels 170 may be attached to the frame 160 by a plurality of hinges 171 on a first end 172 of the wall module 20 to allow the panels 170 to move from a closed position as shown in FIG. 12 to an open position (not shown). A plurality of closures 174 at a second end 176 of the module 20 may be used to secure the panels 170 in the closed position. The panels 170 may further include an extruded aluminum frame 173 surrounding the panels 170. The panels 170 may be assembled to prevent moisture and wind from entering as well as to prevent vandalism and to allow for maintenance of the items enclosed therein. The panels 170 may be translucent and may include a display such as an advertisement. In a preferred embodiment, the pair of panels 170 may be formed from glass, more preferably the pair of panels 170 may be formed from tempered, opaque glass having a thickness of about 0.315 inches.

The frame 160 and the pair of panels 170 together define an interior space 178 as shown in FIG. 12. At least one light source 180 may be disposed within the interior space 178. The light source 180 may be fluorescent, neon, incandescent, or other light sources positioned to illuminate the space 178.

The frame 160 is constructed separately from the wall 18 and the roof structure 16 without substantial rigid links, however minor links may be made to other elements of the shelter 10 that do not transfer a substantial amount of vibration or movement between the wall module 20 and the remainder of the shelter. Any vibration or movement transferred through the foundation will likely be ineffectual to the structural integrity of the components. Additionally, the frame 160 may be embedded in the foundation 12 in common with the posts 14 or other support structures. In a preferred embodiment, the frame 160 may be constructed from ASTM A-36 galvanized steel. The frame 160 may further comprise cladding made from stainless steel, AISI 304L series attached to the galvanized steel. Optionally, the cladding may have an exterior painted finish. The thickness of the cladding will vary, preferably, the thickness to the cladding may be about 0.4 to about 0.2 inches. The wall module 20 may be assembled by welding, bolting, screwing, or riveting, or a combination thereof, or any assembling means known to one of skill in the art. The frame 160 and the panels 170 may be sealed by way of example, but not limited to, using a sealant, such as transparent DOW 912 sealant continuously applied around the periphery of the panels 170.

Figure 15:
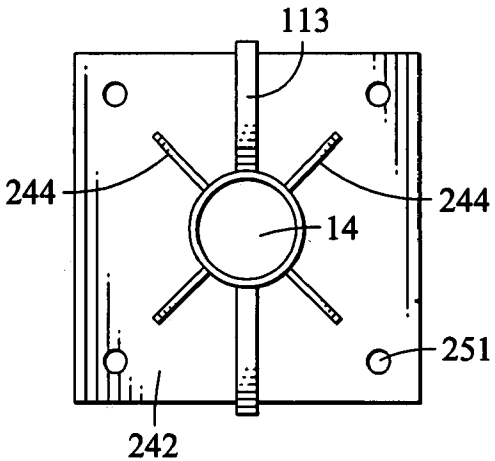
FIG. 15 is a top plan view of a base plate of the post shown in FIG. 2A.
Figure 14:
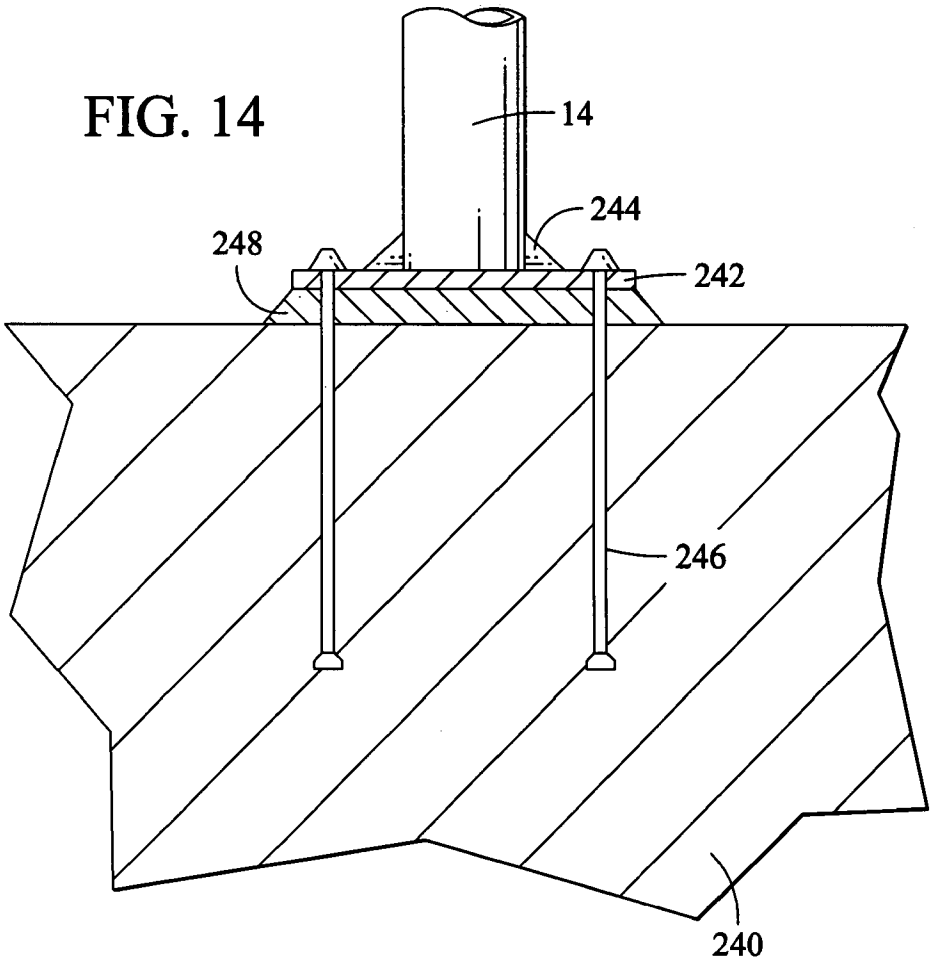
FIG. 14 is a partial view of a footing of the preferred embodiment shown in FIG. 1.

The shelter 10 is attached at various attachment points securely to the foundation 12. Each of the posts 14 and the vertical supports 162 of the wall module 20 may be secured to sunken cement footings 240, as shown in FIG. 14. However, alternative foundations may be used with the present invention, such as a mat foundation, staked configurations and other foundations known to one of skill in the art. As shown in FIGS. 2A and 2B, the posts 14 comprise foundation attachments 36. The attachments 36 further include a base plate 242 and a plurality of braces 244, the braces 244 extending radially from the post 14 around the circumference of the post 14, more preferably four braces 244 extending radially, and equidistantly spaced apart. As shown in FIG. 15, the position of the projections 113 of the support attachments 38 is shown in relation to the braces 244. The braces 244 are spaced apart from the projections 113. The base plate 242 is preferably secured to the footing 240 at each of the four corners 251 of the base 242. As shown in FIG. 14, the plate 242 is secured to the foundation 12 with attachments 246 in each of the corners 251 of the plate 242. Leveling grout 248 may be used between the base 242 and the footing 240. A finished floor may optionally be poured above the footings 240, preferably about six inches or greater above the footing 240.

In a preferred embodiment, a footing poured in sandy soil conditions with 2000 psf soil bearing capacity is preferably about 2 to 4 feet in depth, more preferably about 2 feet, 9 inches to about 3 feet, six inches. A preferred width and length for the footings 240 is about 3×3 to about 4×4 feet wide and long. Steel reinforcement bars may be used within the footings 240. Of course, alternative footings may be used and may be reduced for rock soil conditions. The preferred base plates 242 and the braces 244 are formed from stainless steel, AISI 304 series. A preferred attachment 246 may be ⅝ inch (nominal) anchor bolts with a minimum of about 8 inches penetration into the concrete of the footing A. Preferably, the concrete of the footing 240 will develop a 28 day minimum compressive strength of about 4000 psi. Reinforcement bars, when used, may be ASTM-615 bars.

As shown in FIG. 1, the roof structure 16 may further include a plurality of photovoltaic solar panels 22 engaged with the frame 54. The plurality of solar panels 22 operate to generate potential upon the absorption of radiant solar energy. The panels may be arranged and connected so as to provide power sufficient to charge batteries for illuminating a light source 180 for the wall module 20 and, optionally, to illuminate a light source 56 for the roof structure 16 of the shelter 10. Any solar panel assembly having photovoltaic generators including amorphous, silicon cells, crystalline silicon cells, polycrystalline silicon cells, cadmium sulfide cells, gallium arsenide cells and others known to one of skill in the art may be used. A multi-crystalline solar panel suitable for use in the present invention is available through BP Solar, Maryland, USA, preferably type BP3160.

Figure 13:
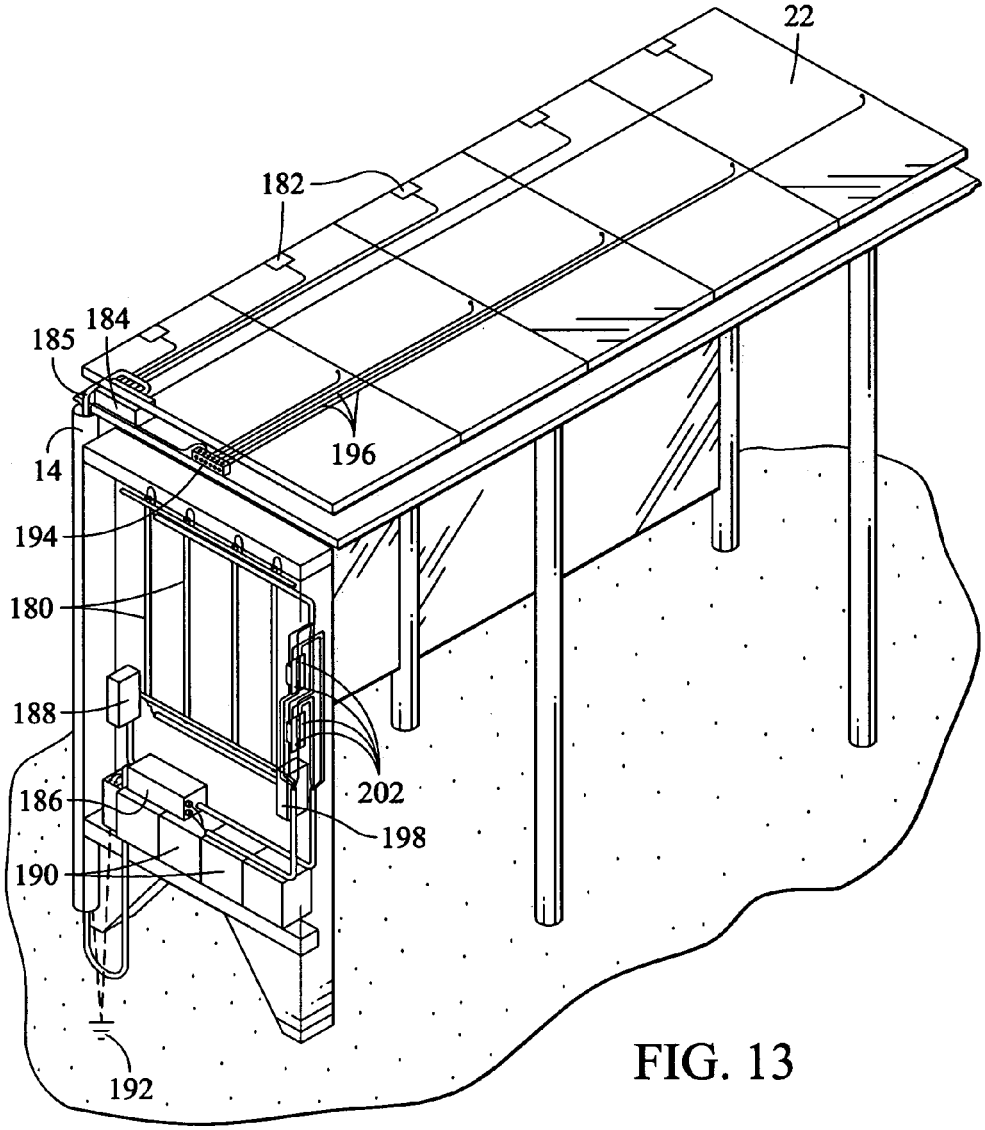
FIG. 13 is a diagram of an energy transmission scheme of a preferred embodiment according to the present invention.

The power circuitry for providing power to the light source 180, and optionally the light source 56, is shown in FIG. 13. Each of the solar panels 22 comprises a connection module 182 connected to a fuse box 184. As shown, the electrical wiring 185 connects the box 184 through the post 14 into the ground (or in the foundation) and up through the brace 166 of the wall module 20 and into a protection box 186. The protection box 186 connects to a charge regulator 188, and a plurality of batteries 190. Additionally, the protection box 186 is connected to an earth rod 192. The earth rod 192 also connects to a ground bar 194 in the roof structure 16 connecting to a plurality of ground wires 196. The protection box 186 also connects to a load regulator 198 within the wall module 20. The load regulator 198 connects to a plurality of ballasts 202 which provide the power to the light source 180 as shown. Additionally, the ballasts 202 may provide power to the light source 56. Optionally, the power circuitry may further include a timer and a photoelectric sensor (not shown). The timer and the photoelectric sensor may be added to control the time during which the light source 180 provides light or the photoelectric sensor to detect darkness and to control the operation of the light source 180. These and other exemplary components, known to one of skill in the art, may be used to supply the power from the solar panels 22 to the light source 180 and provide control relating thereto. The components, such as the protection box 186, the charge regulator 188, the batteries 190, the load regulator 198, the ballasts 202 and others described herein may be included within the interior 178 of the wall module for protection from the elements and from vandals.

It should be noted that solar components may not necessarily be the exclusive means for providing power and illumination to the shelters described herein. Conventional power supplies may be used.

Although the invention has been described in connection with a preferred embodiment thereof, it will be appreciated by those skilled in the art that additions, modification, substitutions, and deletions not specifically described may be made without departing from the spirit and scope of the invention as defined in the appended claims. The scope of the invention is defined by the appended claims, and all devices that come within the meaning of the claims, either literally or by equivalence, are intended to be embraced therein.

The invention claimed is:

1. A shelter comprising:

a plurality of supports upstanding from a fixed foundation, said supports arranged to at least partially surround a spatial area;

at least one roof structure mounted to said plurality of supports, said roof structure positioned over said spatial area and said roof structure having a first edge;

at least one freestanding wall structure secured to said foundation and substantially unconnected to said roof, said wall structure having an edge extending parallel to said first edge of said roof structure and said wall structure comprising an interior space defined by a pair of spaced apart panels;

at least one solar-powered light source at least partially disposed in said interior space, said light source providing illumination for said spatial area; and a plurality of solar panels secured to said roof structure, said solar panels providing power to said light source, and circuitry and power storage componentry in communication with said solar panels is mounted within said interior space;

wherein said solar panels are linked to said circuitry and power storage componentry through said foundation.

2. A shelter comprising:

a plurality of supports secured to and upstanding from a fixed foundation, said supports arranged to at least partially surround a spatial area;

at least one roof structure mounted to said plurality of supports, said roof structure positioned over said spatial area and said roof structure having a first edge;

at least one freestanding wall structure secured to said foundation and substantially unconnected to said roof, said wall structure having an edge extending parallel to said first edge of said roof structure;

at least one wall secured to at least one of said supports and extending at least partially between said roof structure and said foundation; and a plurality of horizontal support members extending between at least two of said supports, said support members providing support for said at least one wall.

3. The shelter of claim 2 wherein separation between said freestanding wall structure and said supports substantially prevents the transfer of vibration to said supports or said roof structure.

4. The shelter of claim 2 further comprising at least one solar-powered light source, said light source providing illumination for said spatial area.

5. The shelter of claim 4 wherein said freestanding wall structure further comprises an interior space defined by a pair of spaced apart panels, and said at least one light source is at least partially disposed in said interior space.

6. The shelter of claim 5 further comprising a plurality of solar panels secured to said roof structure, said solar panels providing power to said light source, and circuitry and power storage componentry in communication with said solar panels is mounted within said interior space.

7. The shelter of claim 2 wherein said freestanding wall structure extends approximately perpendicularly to said at least one wall.

8. The shelter of claim 2 wherein said freestanding wall structure extends at least partially beneath said roof structure.

9. The shelter of claim 2 wherein said freestanding wall structure comprises advertising displayed within said freestanding wall structure.

10. A method of providing a wind resistant shelter comprising the steps of:

providing a plurality of upstanding supports secured to a foundation, said supports arranged to at least partially surround a spatial area in a non-symmetrical configuration;

providing a roof structure secured to said plurality of supports;

providing at least one wall secured to said at least one of said supports, said wall providing space between said foundation and said roof structure for air flow therethrough; and providing at least one freestanding wall structure positioned adjacent to at least one of said supports and having a space defined around the freestanding wall structure and any adjacent structure of said shelter.

11. The method of claim 10 wherein the step of providing said at least one freestanding wall structure allows said freestanding wall structure to vibrate in response to wind forces in isolation from vibrations of said supports, said roof structure and said at least one wall.

12. The method of claim 10 further comprising the step of providing a light source to illuminate said spatial area.

13. The method of claim 12 further comprising the step of providing solar panels to provide power for said light source.

14. The method of claim 10 further comprising the step of providing advertising within said at least one freestanding wall structure.

15. The method of claim 10 further comprising the step of providing solar-powered illumination means for illuminating said shelter.

* * * * *

UNITED STATES PATENT AND TRADEMARK OFFICE

CERTIFICATE OF CORRECTION

PATENT NO. : 7,237,360 B2 
APPLICATION NO. : 10/670159
DATED : July 3, 2007
INVENTOR(S) : Fernando R. Moncho et al.

It is certified that error appears in the above-identified patent and that said Letters Patent is hereby corrected as shown below:

On the Title Page

In column 2, line 7, after "12/1998" delete "Sauder" and substitute --Sander-- in its place.

Signed and Sealed this

Second Day of October, 2007

JON W. DUDAS
*Director of the United States Patent and Trademark Office*